US007774867B2

(12) United States Patent
Orita et al.

(10) Patent No.: US 7,774,867 B2
(45) Date of Patent: Aug. 17, 2010

(54) AIRBAG JACKET FOR A VEHICLE RIDER

(75) Inventors: Masayoshi Orita, Saitama (JP); Hiroshi Goto, Saitama (JP); Yuki Kobayashi, Saitama (JP); Hiroyuki Kikuchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/009,510

(22) Filed: Jan. 18, 2008

(65) Prior Publication Data

US 2008/0178370 A1 Jul. 31, 2008

(30) Foreign Application Priority Data

Jan. 31, 2007 (JP) ..... 2007-021563

(51) Int. Cl.
*A41D 13/00* (2006.01)

(52) U.S. Cl. ..... 2/456; 2/DIG. 3

(58) Field of Classification Search ..... 2/102, 2/456, 463–465, 467, DIG. 3
See application file for complete search history.

(56) References Cited

U.S. PATENT DOCUMENTS 5,567,191 A * 10/1996 Gordon ..... 441/117
5,746,442 A * 5/1998 Hoyaukin ..... 280/730.1
5,867,842 A * 2/1999 Pinsley et al. ..... 2/462
6,546,561 B2 * 4/2003 Duhamell ..... 2/102

FOREIGN PATENT DOCUMENTS

| | | |
|---|---|---|
| JP | 09-066789 | 3/1997 |
| JP | 2003-312569 | 11/2003 |
| JP | 2004-162224 | 6/2004 |

* cited by examiner

*Primary Examiner*—Tejash Patel
(74) *Attorney, Agent, or Firm*—Carrier, Blackman & Associates, P.C.; William D. Blackman; Joseph P. Carrier

(57) ABSTRACT

An airbag jacket, to be fitted in a rider jacket, includes an airbag body configured to fill with gas from an inflator operatively connected with the airbag body. The airbag body includes a flat front piece, a flat back piece substantially identical to the flat front piece; the flat front and back pieces having an opening formed therein for permitting an user of the airbag jacket to pass his or her head therethrough. The flat front and back pieces are joined together along a peripheral boundary thereof and along a peripheral boundary of the opening by sewing or bonding so as provide a plurality of continuously formed body covering portions including at least a back covering portion, a shoulder covering portion and a front covering portion.

21 Claims, 12 Drawing Sheets

AIRBAG JACKET FOR A VEHICLE RIDER

CROSS-REFERENCE TO RELATED APPLICATIONS

The present application claims priority under 35 U.S.C. §119 based on Japanese patent application No. 2007-021563, filed on Jan. 31, 2007. The entire subject matter of this priority document is herein incorporated by reference.

BACKGROUND OF THE INVENTION

1. Field of the Invention

The present invention relates to an airbag jacket for a rider of a saddle-type vehicle such as a motorcycle, three-wheeler or all-terrain vehicle (ATV). More particularly, the present invention relates to an airbag jacket, fitted with a rider jacket worn by the vehicle rider, and having a plurality of continuously formed body covering portions formed by joining a plurality of substantially flat members.

2. Description of the Background Art

There are known airbag systems having an airbag body and an inflator fitted with clothing (e.g., a jacket) worn by a rider of a vehicle, e.g., a motorcycle. In such airbag systems, the airbag body is inflated, and deployed by gas from the inflator, to absorb an impact on the rider.

The examples of known airbag systems include those having an airbag body shaped like a slender tube (e.g., slim, lean tube) with turned-back portions, and in which a gas passage is formed in the airbag body (see the Japanese Patent Document: JP-A No. 2004-162224), and those having plural airbag bodies to cover various parts of the rider's body, the plural airbag bodies are held in a folded state (see the Japanese Patent Documents: JP-A No. 2003-312569 and JP-A No. H09-66789).

In the existing airbag systems, the airbag is either configured such that the airbag body is shaped like a tube having turned-back portions, or each includes of plural bag portions combined together. In these airbag systems, the gas released from an inflator is required to flow through one or more of complicated (e.g., narrower) passages. In such configurations, installing one or more of hoses in the airbag body to secure one or more of gas passages increases the number of components required.

Moreover, in the existing airbag bodies including, for example, turned-back portions have complicated three-dimensional shapes. Producing such airbag bodies, therefore, involves three-dimensional sewing which complicate sewing and bonding processes.

The present invention has been made to overcome such drawbacks. Accordingly, it is an object of the present invention to provide an airbag jacket which can be quickly filled with gas and which can be produced through easy to perform two-dimensional sewing and bonding processes.

SUMMARY OF THE INVENTION

To achieve the above-mentioned object, the present invention provides an airbag jacket fitted in a rider jacket. The airbag jacket includes an airbag body which is shaped like a bag and which can be easily filled with gas from an inflator. In the airbag jacket, the airbag body has a flat front piece (also referred as a front flat member or a front member) and a flat back piece (also referred as a back member, rear flat member or rear member) joined together by sewing or bonding; the airbag body having a through hole which a rider can pass his or her head through is formed in the airbag body; at least a back covering portion, a shoulder covering portion, and a front covering portion are continuous in the airbag body; the inflator is provided in the back covering portion; and gas from the inflator flows from the back covering portion to the front covering portion via the shoulder covering portion to fill the continuous portions of the airbag.

According to this embodiment, the airbag body has the flat front piece and the flat back piece joined together by a two-dimensional sewing or bonding; the through hole which a rider can pass his or her head through is formed in the airbag body; at least one back covering portion, the shoulder covering portion, and the front covering portion which are continuous in the airbag body shaped like a bag; the inflator is provided in the back covering portion; and gas from the inflator flows from the back covering portion through the shoulder covering portion to the front covering portion to fill the continuous portions. Therefore, the airbag body can be quickly filled with gas, and sewing and bonding to be performed can be made easy.

In the above airbag jacket configuration, the airbag body, when worn by the user, is preferably laterally symmetrical. This configuration makes it possible to simplify the shape of the airbag body, and also makes it easier to performing sewing and bonding operations.

Also, the airbag body is preferably side-gapped when worn by the user. Accordingly, the airbag jacket may be fitted in a rider jacket having side fastening arrangements with a fastener line provided on either left or right side.

Further, it is desirable that the airbag body is front-gapped when worn by the user. According to the configuration, the airbag jacket may be fitted in a rider jacket having a front fastening arrangement with a fastener line provided centrally and vertically thereon.

Further, in the above configuration, a side back covering portion is preferably provided on one side or each side of the back covering portion, the side back covering portion being continuous with the back covering portion, and is fillable with the gas from the inflator. According to the configuration, the airbag body can more extensively cover the upper body portions of the rider.

In the above configuration, a boundary between the back covering portion and the side back covering portion is preferably partly closed by sewing or bonding. Therefore, the boundary between the back covering portion and the side back covering portion can be partly closed without increasing the number of airbag body components.

The airbag body further includes a front flank covering portion preferably provided continuously with the side back covering portion that is continuous with the back covering portion, the front flank covering portion being fillable with the gas from the inflator. Therefore, the airbag body can more extensively cover the upper body portions of the rider.

The airbag body further includes a side front covering portion preferably provided on one side or each side of the back covering portion, the side front covering portion being continuous with the front covering portion and fillable with the gas from the inflator. According to such configuration, the airbag body can cover the front flank of a rider without requiring any side front covering portion for covering the rider's front flank to be provided continuously with the front covering portion.

In the above configuration, a boundary between the front covering portion and the side front covering portion is preferably partly closed by sewing or bonding. Accordingly, the boundary between the front covering portion and the side front covering portion can be partly closed without increasing the number of airbag body components.

Advantages of the Invention

According to the present invention, the airbag body includes the flat front piece and the flat back piece joined together by sewing or bonding; each of the flat front and back pieces having a through hole formed therein through which a rider can pass his or her head through; at least a back covering portion, a shoulder covering portion, and a front covering portion formed continuously within in the airbag body; the inflator provided in the back covering portion. According to the present invention, gas from the inflator (during its activation) flows from the back covering portion to the front covering portion via the shoulder covering portion to fill these continuously formed portions. Hence, the airbag body can be quickly filled with gas, and sewing and bonding to be performed can be made easy.

Since the airbag body is shaped to be laterally symmetrical when worn, sewing and boding to be performed to produce the airbag body can be made easier.

Also, since the airbag body is side-gapped when worn, it can be fitted in a rider jacket shaped for side fastening.

Further, since the airbag body is front gapped when worn, it can be fitted in a rider jacket shaped for front fastening.

The side back covering portion is formed on one side or each side of the back covering portion, the side back covering portion being continuous with the back covering portion and fillable with the gas from the inflator, so that the airbag body can more extensively cover the upper body portions of the rider.

The boundary between the back covering portion and the side back covering portion is partly closed by sewing or bonding. Therefore, the boundary between the back covering portion and the side back covering portion may be partly closed without increasing the number of airbag body components.

The front flank covering portion is continuously formed with the side back covering portion that is continuous with the back covering portion, the front flank covering portion being fillable with the gas from the inflator, so that the airbag body can more extensively cover the upper body portions of a rider.

The side front covering portion is provided on one side or each side of the back covering portion, the side front covering portion being continuous with the front covering portion and fillable with the gas from the inflator, so that the airbag body can cover the front flank of a rider without requiring any side front covering portion for covering the rider's front flank to be provided continuously with the front covering portion.

The boundary between the front covering portion and the side front covering portion is partly closed by sewing or bonding. Thus, the boundary between the front covering portion and the side front covering portion can be partly closed without increasing the number of components required for forming the airbag body.

For a more complete understanding of the present invention, the reader is referred to the following detailed description section, which should be read in conjunction with the accompanying drawings.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

A few illustrative embodiments of the present invention are described below with reference to the accompanying drawings.

First Embodiment

Figure 1:
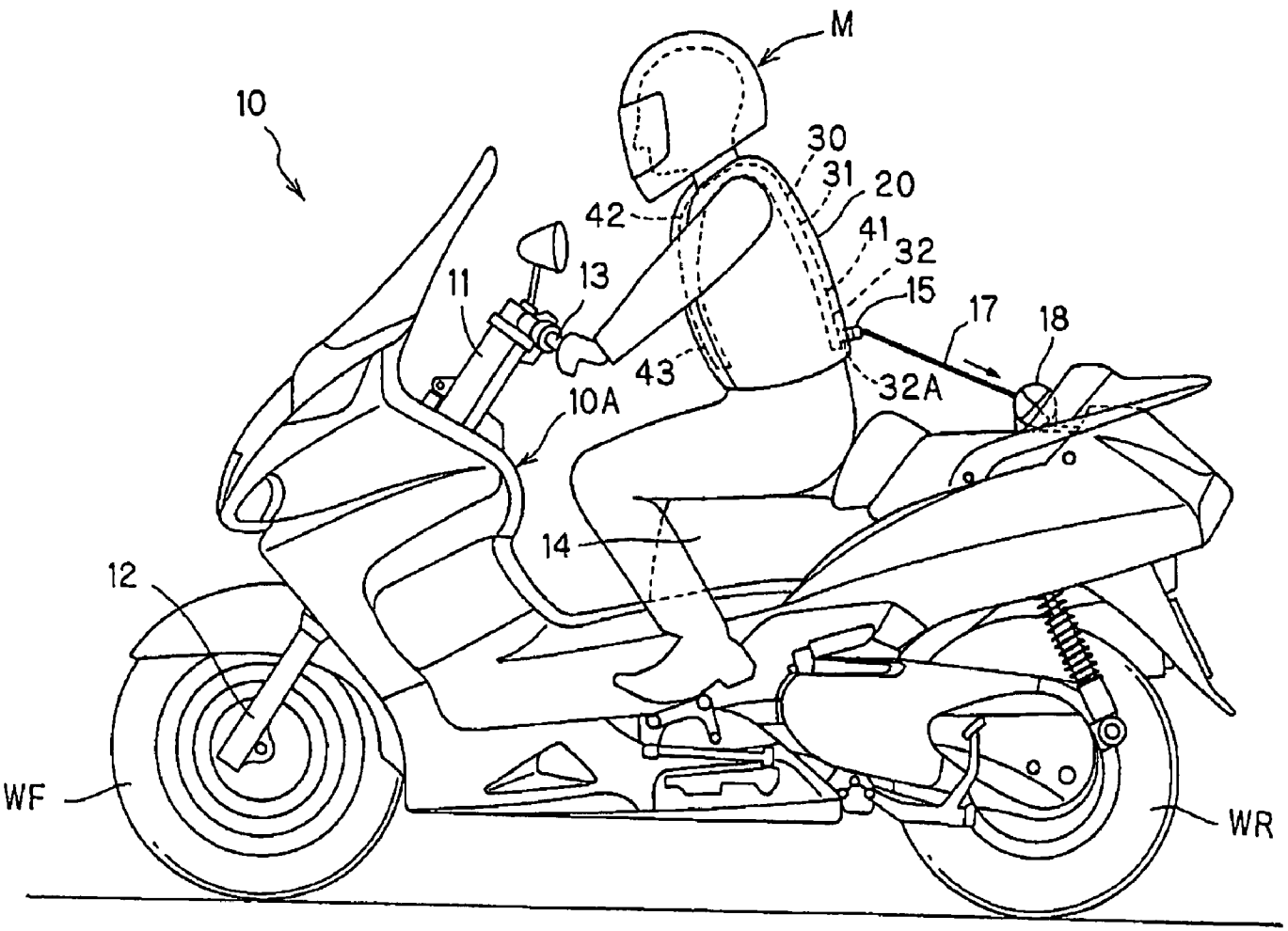
FIG. 1 is a side view of a motorcycle rider wearing an airbag jacket of a first embodiment of the present invention.

FIG. 1 shows a motorcycle rider M, riding a motorcycle 10, and wearing an airbag jacket 30 fitted with a rider jacket 20 according to a first embodiment of the present invention.

As shown in FIG. 1, the motorcycle 10 has a head pipe 11 in a front end portion of a body frame 10A (also referred as a body). The head pipe 11 steerably supports a front fork 12 to which a front wheel WF is journaled. A steering handlebar 13 is attached to an upper portion of the front fork 12. A rear wheel WR which is driven by an engine is suspended in a rear portion of the body frame 10A. A seat 14 is provided at the top of an intermediate portion, in the front-rear direction, of the body frame 10A.

Figure 2:
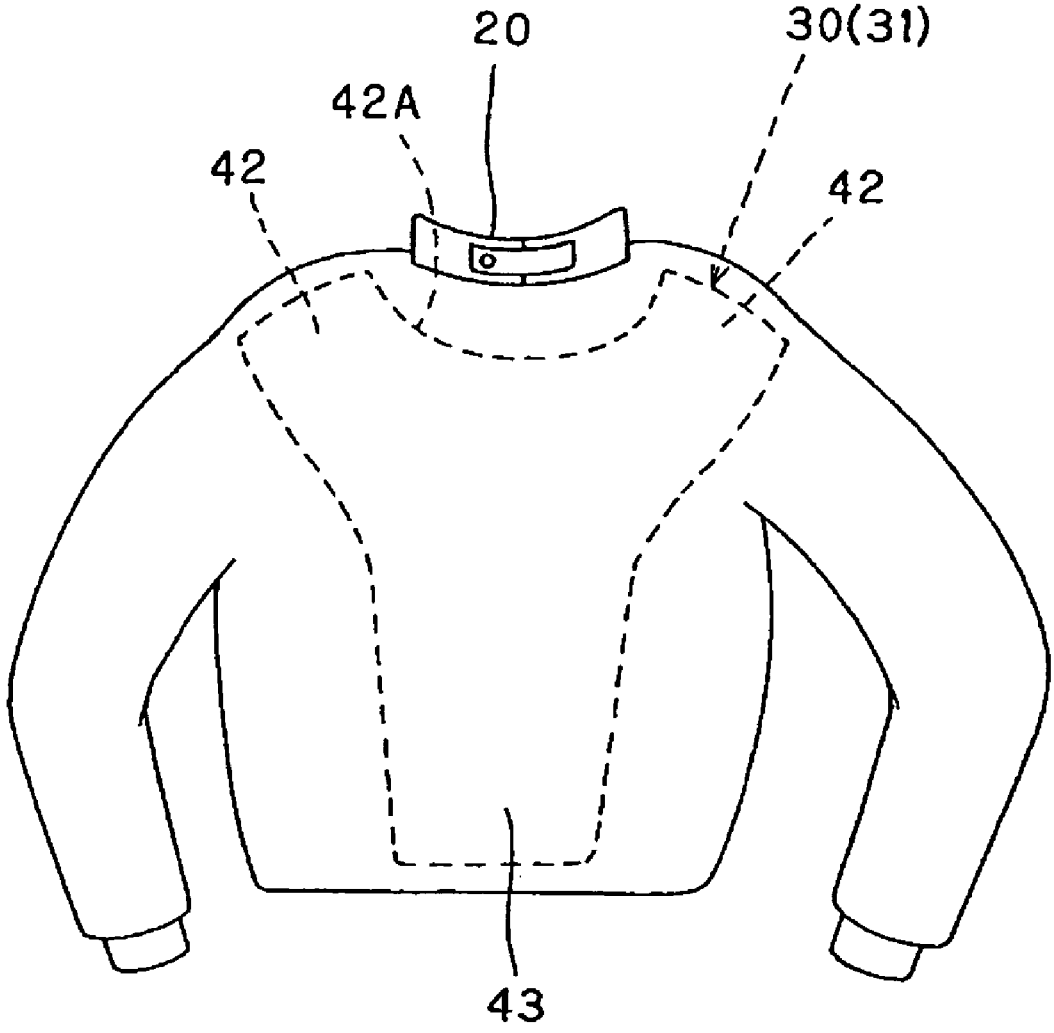
FIG. 2 is a front view of a rider jacket provided with the airbag jacket according to the first embodiment of the present invention.

The rider M wearing the rider jacket 20 sits on the seat 14. As shown in FIG. 2, the airbag jacket 30 is fitted with the rider jacket 20.

The airbag jacket 30 functions as a wearable airbag system for providing safety to the ride of the vehicle during collision, accidents, etc. The airbag jacket includes an airbag body 31 and an inflator 32 (see FIG. 1) operatively connected with the airbag body 31. The inflator 32 is disposed in a back covering portion 41 of the airbag body 31.

The inflator 32, when activated, generates a pressurized gas by a known method such as a gasification method, a method using solid or miscible gas, or an air drawing method. The pressurized gas generated by the inflator 32 (when activated) inflates the airbag body 31.

As shown in FIG. 1, the inflator 32 includes an activation section 32A adaptable to receive a detachable activation switch 15. During vehicle operation, the detachable activation switch 15 is connected with the activation section 32A of the inflator 32.

The detachable activation switch 15 is connected, via a connection cable 17 (serving as a connection body), with the activation section 32A. The activation switch 15 is provided with a sensor which detects a disconnection of the connection cable 17 from the activation switch 15. When the sensor detects a disconnection of the connection cable 17 from the activation switch 15, the inflator 32 is activated.

One end of the connection cable 17 is connected to a pretensioner locking device 18 (also referred as an Emergency Locking Retractor (ELR) device 18); and the other end of the connection cable 17 is connected to the activation switch 32A. The pretensioner locking device 18 is attached to a rear portion of the seat 14. The ELR device 18 has a pretension function and a locking function.

During the pretension function, i.e., when the connection cable 17 is held in a normally connected state using an elastic member (e.g., a spiral spring), the connection cable 17 is pulled by the winding force of the spring to such an extent that the connection cable 17 is taut without hindering the rider's driving operation.

However, during the locking function, i.e., when the acceleration of pulling out of the connection cable 17 (relative acceleration between the rider M and the motorcycle 10) exceeds a predetermined value, the locking function stops the pulling the connection cable 17.

As long as the relative acceleration between the rider M and the motorcycle 10 does not exceed a predetermined value, the ELR device 18 allows the connection cable 17 to be pulled out, so that the rider M can freely move without being conscious about the connection cable 17 connected to the airbag jacket.

If the rider M is, as a result of being subjected to a forward force (during sudden braking operation of the vehicle) moves forward causing the relative acceleration between the rider M and the motorcycle 10 to exceed a predetermined value, the ELR device 18 locks the pulling-out of the connection cable 17, so that, if the rider M is moves off the motorcycle 10, the connection cable 17 is disconnected from the activation switch 15 which cause the inflator 32 to be activated, and thereby releasing pressurized gas from the inflator 32 to fill the airbag body 31.

The mechanism to activate the inflator 32 need not be one configured as described above. Any appropriate activation mechanism selected from a wide range of known mechanisms may be used.

The airbag body 31 of the airbag jacket 30 is described below.

Figure 3:
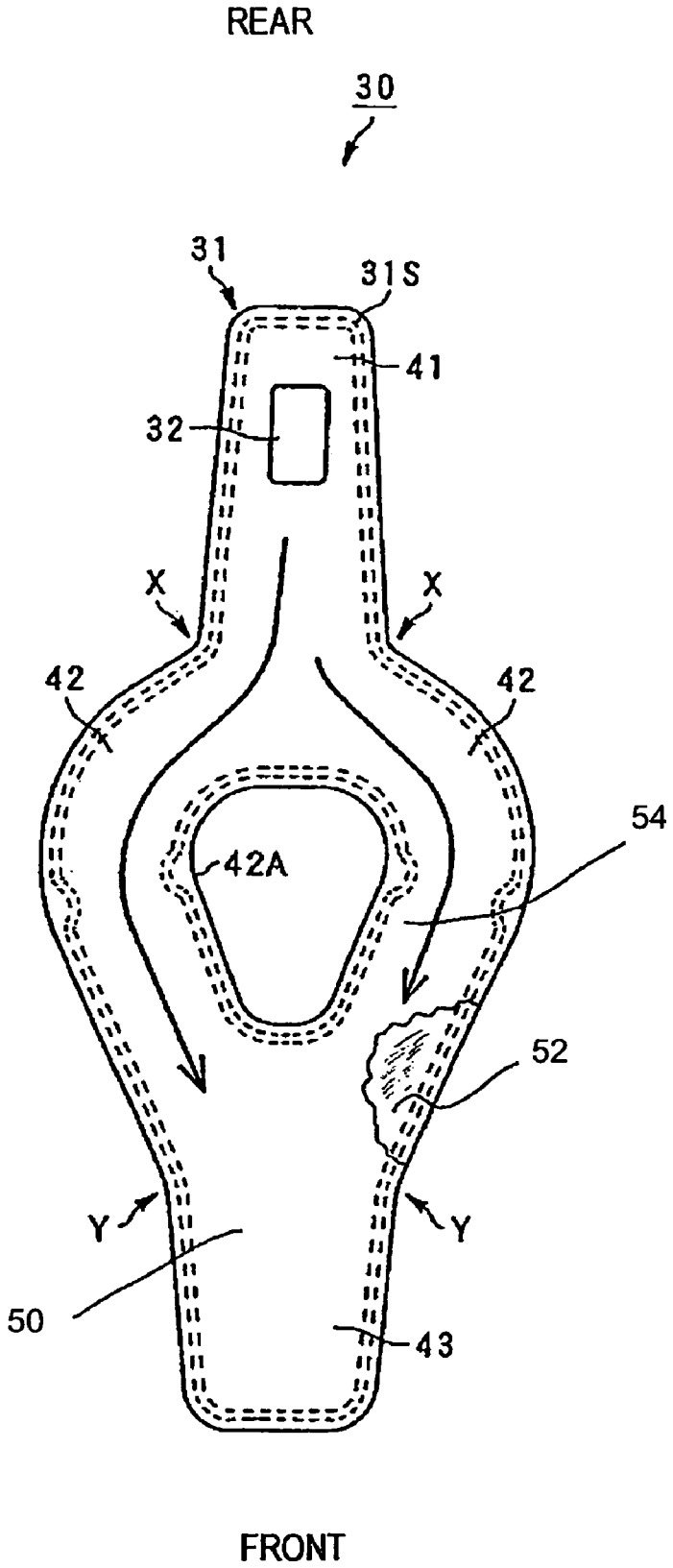
FIG. 3 is a plan view of the airbag jacket of FIG. 2 in an unfolded state.

FIG. 3 shows the airbag jacket 30 in an unfolded state. As shown in FIG. 3, the airbag body 31 includes a flat front piece 50 and a flat back piece 52 substantially identical to the flat front piece 50. The shapes and sizes of the flat front piece 50 and the flat back piece 52 are substantially identical to each other.

The flat front piece 50 and the flat back piece 52 are laid over the each other and joined into a bag-like shape by sewing or bonding their peripheral edge portions together. Such sewing or bonding of peripheral edges of the front and back pieces 50, 52 may be done at more than at one location along their edge portions resulting in a plurality of joined portions 31S of the front and back pieces.

A thin, light, wear-resistant and heat-resistant airbag material, for example, nylon, is used as a foundation material (fabric) for the front and back pieces 50, 52. The foundation fabric is coated with silicon rubber. The silicon rubber coating reduces the friction between the front and back pieces 50, 52 of the airbag jacket 30 and the rider jacket 20, so that damage by friction to the rider jacket 20 is minimized. The front and back pieces 50, 52 are joined together by a method which can secure air tightness of the airbag body. Such methods of joining (bonding) the peripheral portions of the front and back pieces 50, 52, may include a high-frequency welding or a heat welding.

Figure 4A:
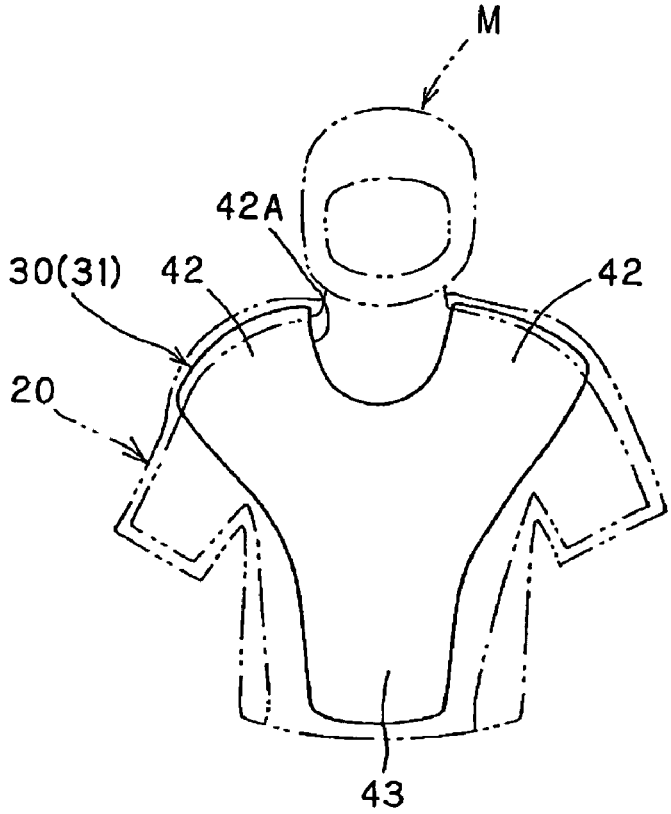
FIG. 4A is a front view of the airbag jacket of FIG. 2 in an inflated state.
Figure 4B:
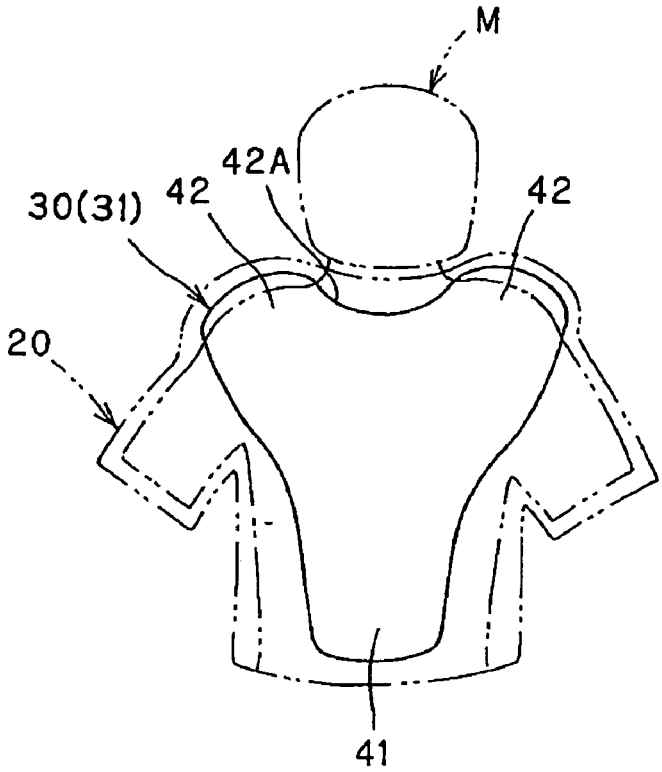
FIG. 4B is a corresponding rear view of the airbag jacket of FIG. 4A.

The airbag body 31 includes a back covering portion 41 which covers the back of the rider M centering on his or her spine, a pair of left and right shoulder covering portions 42, 42 which cover the shoulders of the rider M, and a front covering portion 43 which covers a front portion of the rider M centering on his or her chest through front. In several embodiments of the present invention, the shoulder covering portions 42, 42 are configured and arranged to substantially entirely cover the shoulders of a user, as shown in FIGS. 4A-4B. Optionally, and as also shown in FIGS. 4A-4B, the maximum width of the airbag body at the shoulder portions may be more than twice the width of the front covering portion at an area proximate the lower end thereof. The airbag body 31 is shaped like a symmetrical bag having continuously arranged the back covering portion 41, the pair of left and right shoulder covering portions 42, 42, and the front covering portion 43.

The back covering portion 41 is tapered such that it is gradually wider toward the head/neck of the rider M. The back covering portion 41 is, at its widest portion, divided into left and right portions to be continuous with the left and right shoulder covering portions 42, 42. With the back covering portion 41 having the tapered shape, the curve (denoted by 'X' in FIG. 3) formed on each side of side of shoulder covering portion 42, 42, where the back covering portion 41 is divided into the two parts to be continuous with the left and right shoulder covering portions 42, 42 can be made gentle compared to an airbag having a back covering portion with a uniform width.

Each of the flat front and back pieces includes central portion 54 having a through hole 42A (also referred as an opening 42A) formed between the left and right shoulder covering portions 42, 42 thereof which allows the rider M to pass his or her head therethrough. The left and right shoulder covering portions 42, 42 are gently curved before being joined together with the front covering portion 43.

The left and right shoulder covering portions 42, 42 have an approximately uniform width at positions where they are curved. The left and right shoulder covering portions 42, 42 have a gradually narrower width over a portion where they are joined together, toward the front covering portion 43.

The front covering portion 43 is tapered to be gradually narrower from where it is joined with the shoulder covering portions 42 toward its outer end portion. With the front covering portion 41 having the tapered shape, the curve (denoted by 'Y' in FIG. 3) formed on each side between the shoulder covering portions 42, 42 and the front covering portion 43 can be made gentle.

Thus, in the airbag body 31 (which is shaped like a bag) of the present invention, the back covering portion 41, shoulder covering portions 42, 42, and front covering portion 43 are formed such that they continuous while providing gentle curves for the comfort of the rider M.

In the present embodiment, when the inflator 32 disposed in the back covering portion 41 of the airbag body 31 is activated, the pressurized air (or gas) released from the inflator 32 flows, as shown by arrows in FIG. 3, from the back covering portion 41 towards the left and right shoulder covering portions 42.

Subsequently, the pressurized gas flows into the front covering portion 43 via the shoulder covering portions 42, 42, with minimum obstructions, without passing through curved portions of the airbag 31. Thus, the pressurized gas from the inflator 32 flows quickly from the back covering portion 41 to the front covering portion 43 via the shoulder covering portions 42, 42 to quickly fill the continuous portions of the airbag body (i.e., the back covering portion 41, the shoulder covering portions 42, 42, and the front covering portion 43).

Each of FIGS. 4A and 4B show the airbag jacket 30 in an activated state, a gas-filled state. When filled with pressurized gas, the airbag jacket 30 is entirely inflated, so that it can cover, as shown in FIG. 4A, the shoulders and front portions (including the chest and front) of the rider's body with its airbag. At the same time, as shown in FIG. 4B, it can also cover the shoulders and back portions of the body of the rider M with its airbag. Hence, the airbag jacket 30 can absorb an impact from the outside on the vital upper body portions of the rider M.

In the airbag jacket 30 of the present embodiment, the airbag body 31 covers the front portion of the rider's body with one airbag, so that one-piece clothing which the rider M can pull over his or her head can be used as the rider jacket 20 to be fitted with the airbag jacket 30.

Thus, in the configuration of the present embodiment, the airbag body 31 includes the flat front piece 50 and the flat back piece 52 which are joined together into a bag-like shape such that the back covering portion 41, the shoulder covering portions 42, 42, and the front covering portion 43 are continuously formed. In the airbag body 31, the pressurized gas released from the inflator 32 disposed in the back covering portion 41, flows from the back covering portion 41 to the front covering portion 43 via the shoulder covering portions 42, so that these continuous portions are quickly filled with the pressurized gas.

Moreover, in the configuration of the present embodiment, the flat front piece 50 and the flat back piece 52 of the airbag body 31 are joined together such that the airbag body 31 is laterally symmetrical when worn by the rider.

Therefore, when compared with an airbag body having a complicated three-dimensional shape produced by complicated three-dimensional sewing, the overall shape of the airbag body 31 of the present invention can be simplified, and a two-dimensional sewing and/or bonding thereof can be easily performed.

Second Embodiment

Figure 5:
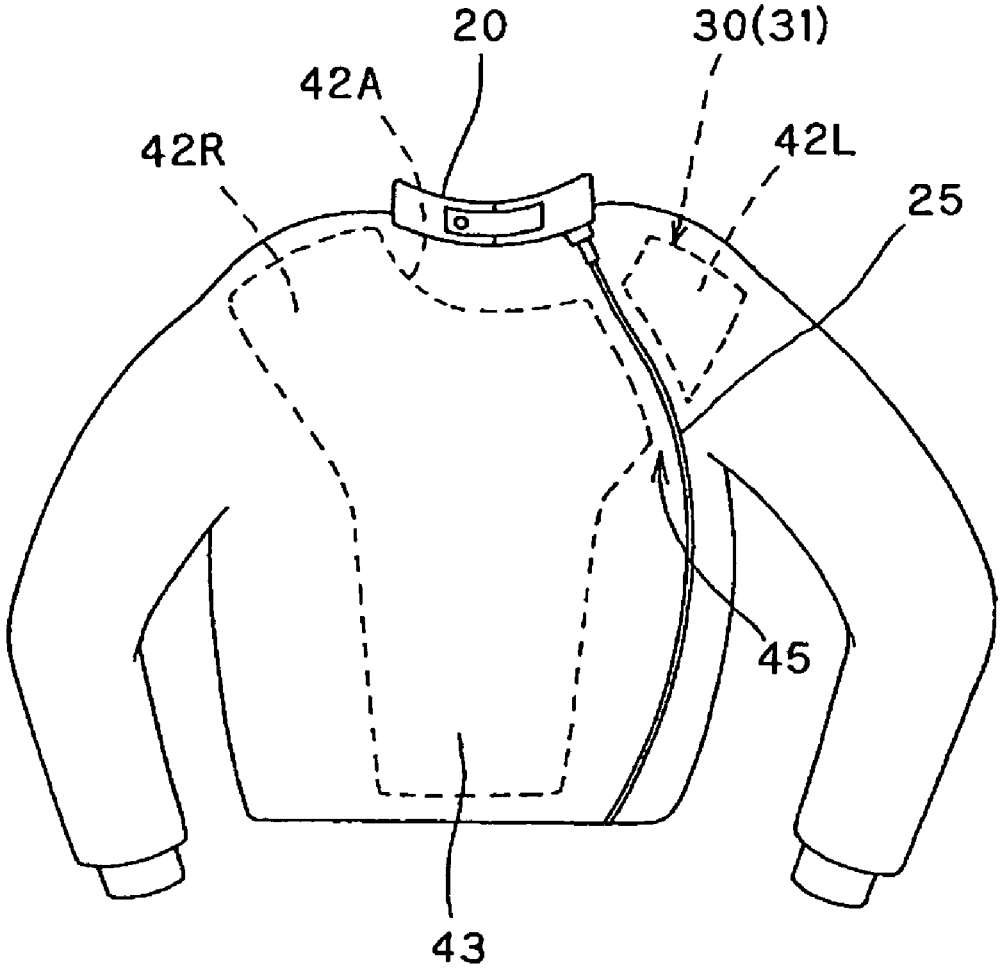
FIG. 5 is a front view of a rider jacket provided with an airbag jacket according to a second embodiment of the present invention.
Figure 6:
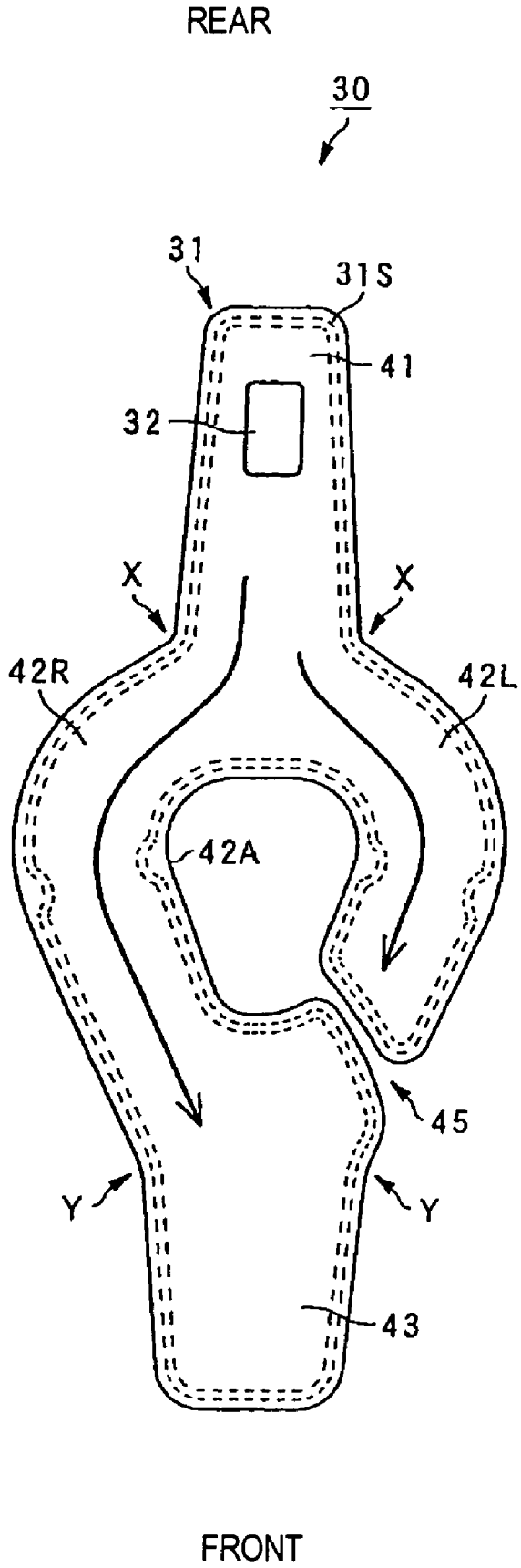
FIG. 6 is a plan view the airbag jacket of FIG. 5 in an unfolded state.

FIGS. 5 and 6 show a second embodiment of the present invention. As shown in these FIGS. 5 and 6, the airbag body 31 according to the second embodiment includes a discontinuous portion 45 (also referred as a gap 45) formed in one of the shoulder covering portion, for example a left shoulder covering portion 42L, so that the airbag body 31 is side-gapped when worn by the user.

In the following description of the second embodiment, features of the present invention, which are similar to those used in the first embodiment, are denoted by the same symbols as used for the first embodiment, and their description is omitted. Features which are different from those used in the first embodiment are described in detail.

As shown in FIG. 5, the rider jacket 20 in which the airbag jacket 30 is fitted in is configured to side fastening with a fastener line 25 provided on a left side (as viewed by the rider M) wearing the rider jacket 20. The airbag body 31 of the airbag jacket 30 has a gap 45 (see FIG. 6) in the shoulder covering portion 42L. The gap is positioned so as to extend along the fastener line 25 of the rider jacket 20.

Therefore, unfastening the fastener 25 provided in the rider jacket 20 makes it possible to open the rider jacket 20 and the airbag body 31 together from their mutually corresponding parts. This makes putting the airbag jacket 30 fitted with the rider jacket 20 on and off easy. The fastener 25 of the rider jacket may be either a slide fastener or a surface fastener.

In the second embodiment, the airbag body 31 is shaped like a bag such that the back covering portion 41, a right shoulder covering portion 42R, and the front covering portion 43 are continuous. Therefore, when the inflator 32 is activated, the pressurized gas released from the inflator 32 flows, as shown by arrows in FIG. 6, from the back covering portion 41 to the front covering portion 43 via the right shoulder covering portion 42R to fill these continuous portions. At the same time, the pressurized gas from the back covering portion flows to and fill the left shoulder covering portion 42L which is continuous with the back covering portion 41. Thus, the pressurized gas released from the inflator 32 can quickly fill these continuous portions.

The airbag body 31 includes the flat front piece 50 and the flat back piece 52 which are joined together. Therefore, when compared to an airbag body having a complicated three-dimensional shape produced by complicated three-dimensional sewing, the overall shape of the airbag body 31 of the present invention can be simplified, and a two-dimensional sewing and/or bonding thereof can be easily performed.

Thus, in the configuration of the present embodiment, the airbag jacket 30 (airbag body 31), when worn, is side-gapped, so that the airbag jacket 30 can be fitted in the rider jacket 20 having the fastener line 25 provided on left side thereof. Furthermore, the gap 45 is provided to extend along the fastener line 25 without extending over the chest portion of the rider M, so that an adequate thickness of the airbag body 31 can be secured to cover vital chest portions of the rider's body.

In an aspect of the second embodiment, in which the rider jacket 20 is provided with the fastener line 25 on a right side thereof, as viewed by the rider M wearing the rider jacket 20, the airbag body 31 may be provided with a gap in the right shoulder covering portion 42R such that the gap extends along the fastener line 25 of the rider jacket 20.

Third Embodiment

Figure 7:
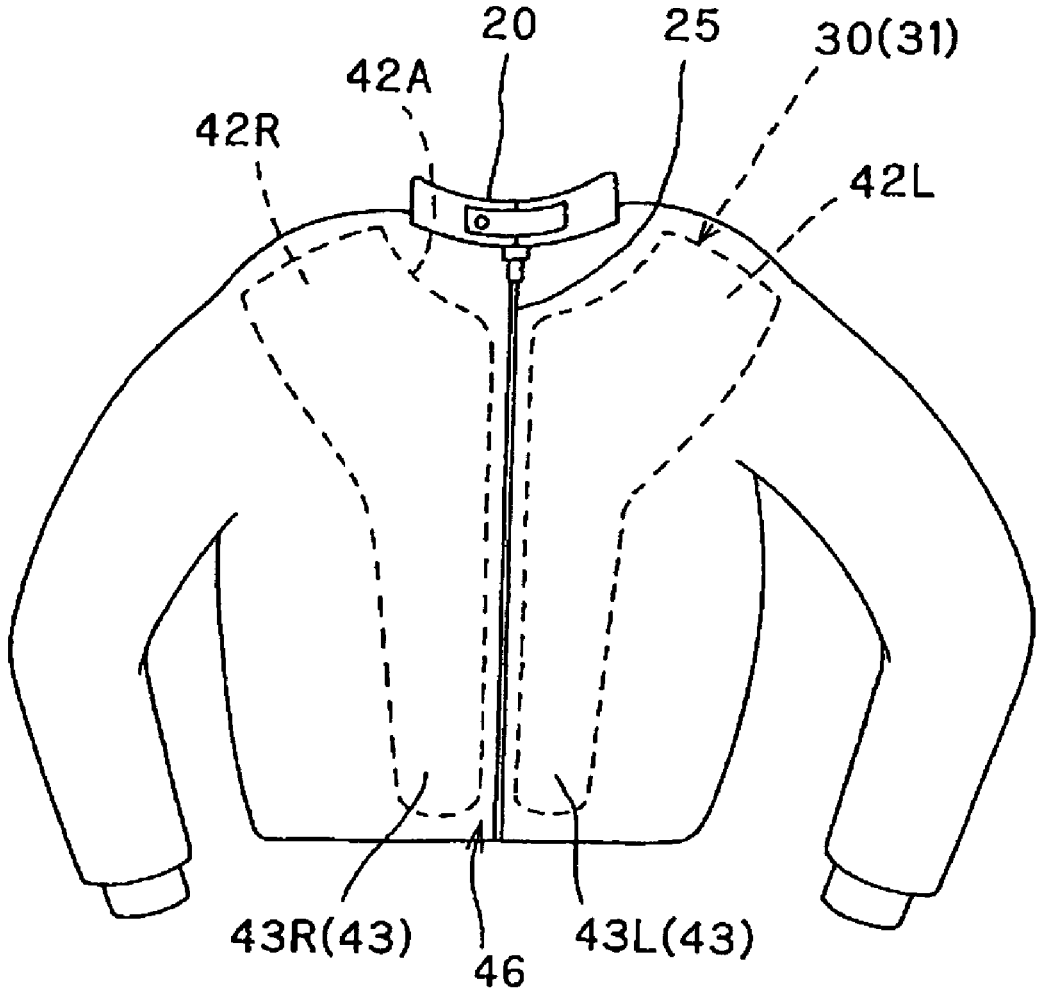
FIG. 7 is a front view of a rider jacket provided with an airbag jacket according to a third embodiment of the present invention.
Figure 8:
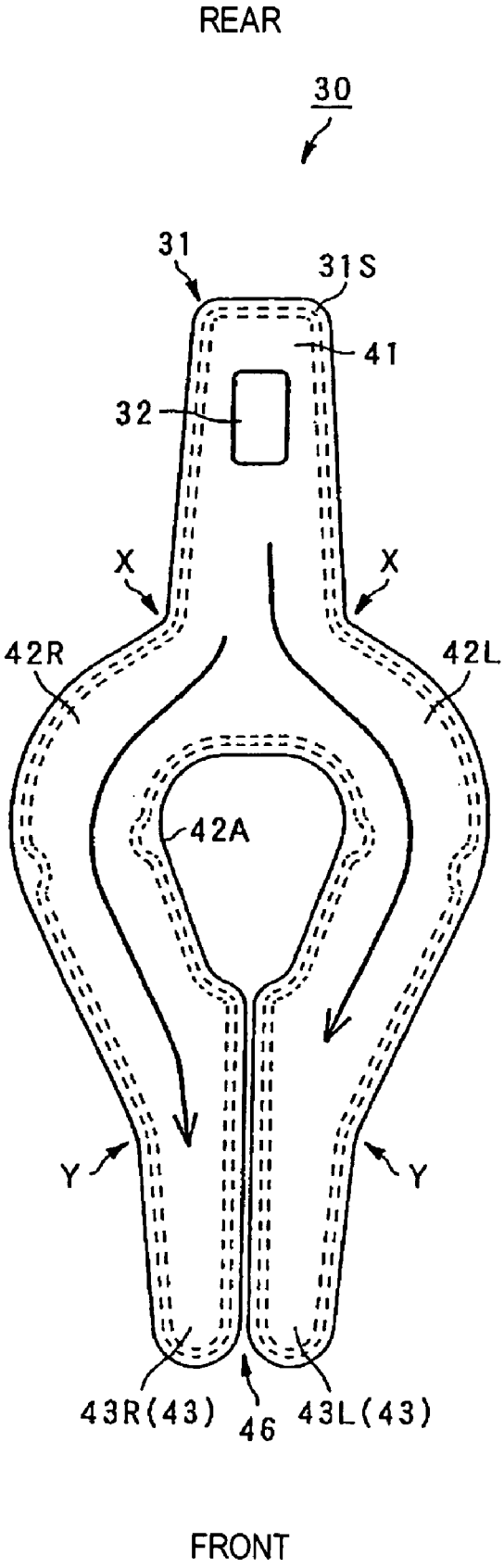
FIG. 8 is a plan view of the airbag jacket of FIG. 7 in an unfolded state.
Figure 9:
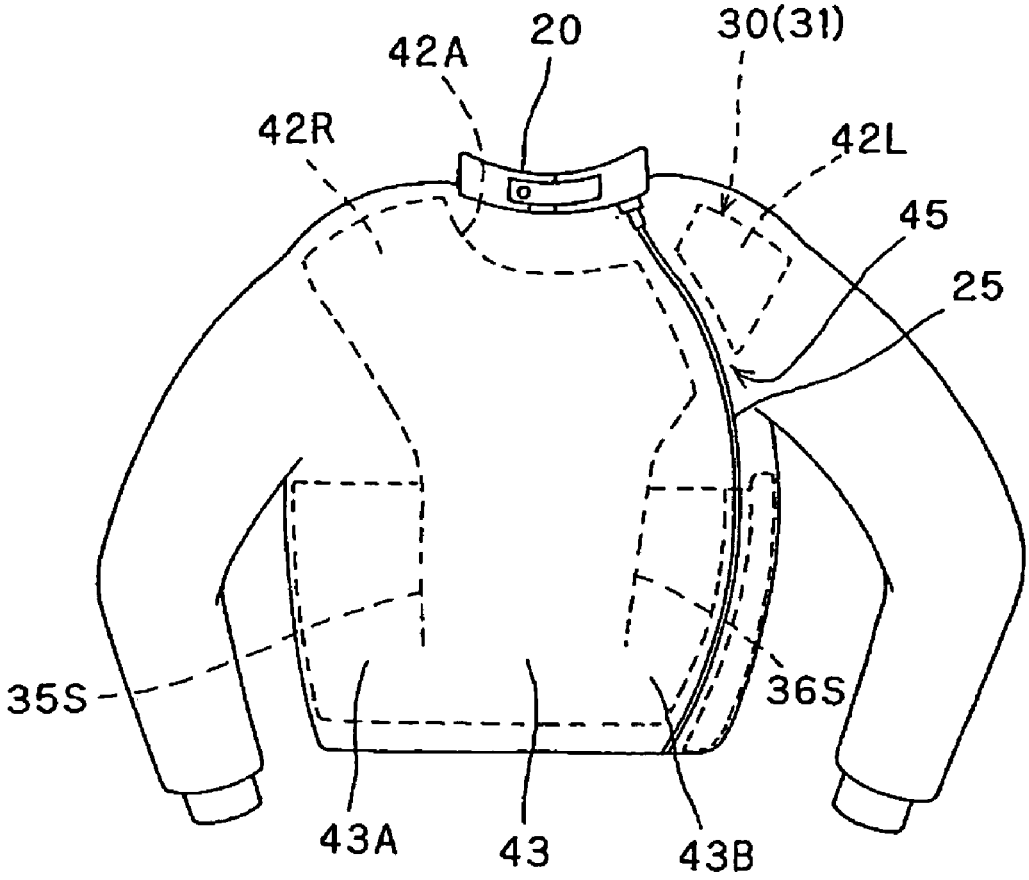
FIG. 9 is a front view of a rider jacket provided with an airbag jacket according to a fourth embodiment of the present invention.

FIGS. 7 and 8 show a third embodiment of the present invention. In the third embodiment, the airbag body 31 includes a vertical discontinuous portion 46 formed in a front portion thereof, i.e., when worn by the rider, the airbag body 31 is vertically front-gapped in front portion (front covering portion 43) thereof.

In the following description of the third embodiment, features of present invention which are substantially same as those used in the foregoing embodiments are denoted by the same symbols as used for the foregoing embodiments, and their description is omitted. The inventive features which different from those used in the foregoing embodiments are described in detail.

As shown in FIG. 7, the rider jacket 20 in which the airbag jacket 30 is fitted in is shaped and/or configured for front fastening with the fastener line 25 extending substantially centrally and vertically in a front portion of the rider jacket 20. As shown in FIG. 8, the airbag body 31 includes the airbag jacket 30 having the discontinuous portion 46 (also referred as a gap 46) formed therein. The gap 46 extends along the fastener line 25 and divides the front covering portion 43 of the airbag body 31 into left and right portions 43L, 43R.

Therefore, unfastening the fastener provided in the rider jacket 20 opens the rider jacket 20 and the airbag body 31 together. Therefore, the rider M can easily put on and off the mutually corresponding portions of the airbag jacket 30 and the rider jacket 20 together.

In the present embodiment, the airbag body 31 is shaped like a bag such that the back covering portion 41, the shoulder covering portions 42L and 42R, and the front covering portion 43 (43L and 43R shown in FIG. 8) are continuous.

Therefore, when the inflator 32 is activated, the pressurized gas released from the inflator 32 flows, as shown by arrows in FIG. 8, from the back covering portion 41 to the front covering portions 43L and 43R via the shoulder covering portions 42L and 42R to fill these continuous portions. Thus, the gas released from the inflator 32 can quickly fill these portions, i.e. from the back covering portion 41 through to the front covering portions 43L and 43R.

The airbag body 31, of the third embodiment, includes the flat front piece 50 and the flat back piece 52 which are joined together. Therefore, when compared to an airbag body having a complicated three-dimensional shape produced by complicated three-dimensional sewing, the overall shape of the airbag body 31 of the present invention can be simplified, and a two-dimensional sewing and/or bonding of the peripheral portion of the flat front piece 50 and the flat back piece 52 can be easily performed.

Thus, in the configuration of the present embodiment, the front-gapped airbag jacket 30 (airbag body 31), when worn by the rider M can be easily fitted in the rider's jacket 20 having the fastener line 25 centrally and vertically extending in its front part.

Fourth Embodiment

FIGS. 9 through 11B show a fourth embodiment of the present invention. In the fourth embodiment, side back covering portions 41A and 41B are provided on the left and right sides of the back covering portion 41 and are continuously formed therewith, and side front covering portions (front flank, side covering portions) 43A and 43B are provided on the left and right sides of the front covering portion 43, and are continuously formed therewith.

In the following description of the present embodiment, the inventive features which are substantially similar to those used in the foregoing embodiments are denoted by the same symbols as used for the foregoing embodiments, and their description is omitted. The inventive features which are different from those used in the foregoing embodiments are described in detail.

Figure 10:
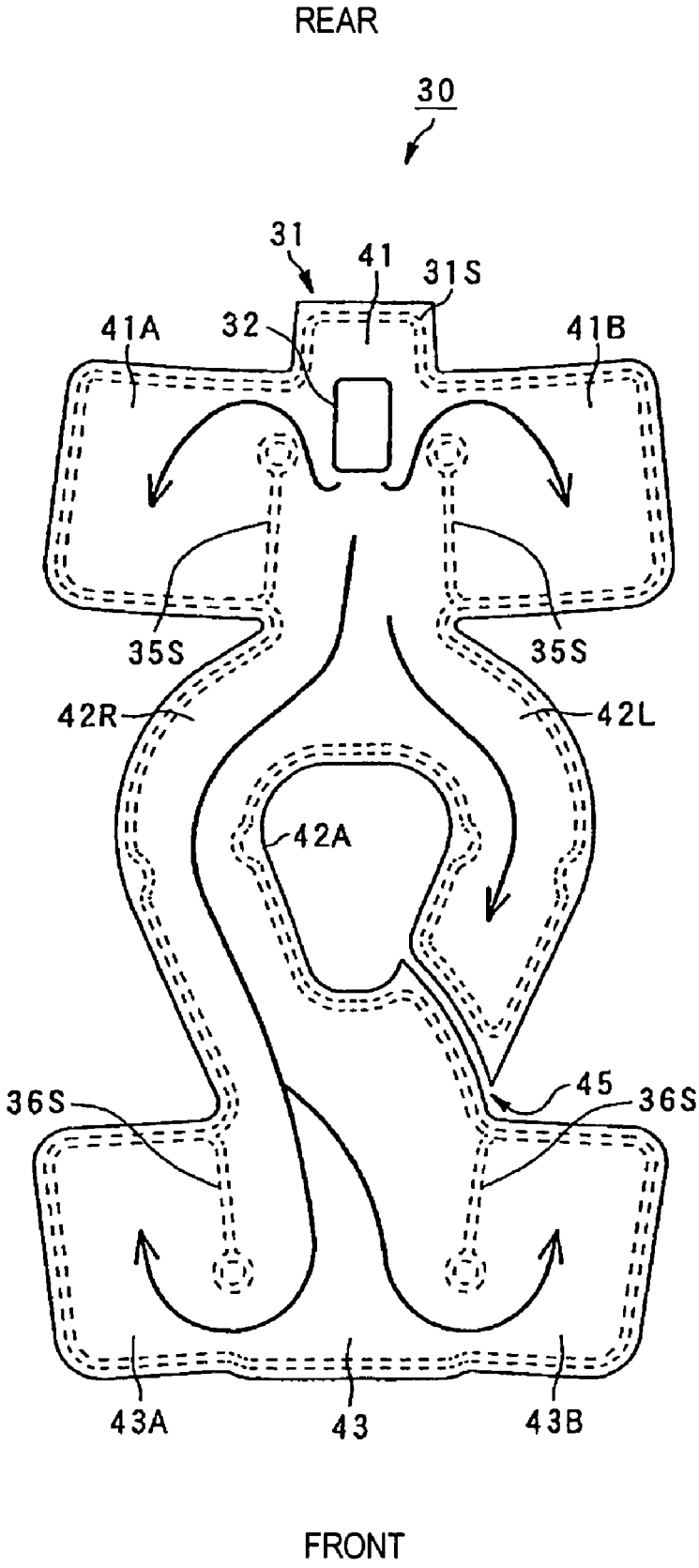
FIG. 10 is a plan view of the airbag jacket of FIG. 9 in an unfolded state.

As shown in FIG. 10, the boundaries between the back covering portion 41 and the side back covering portion 41A and between the back covering portion 41 and the side back covering portion 41B are partly closed by boundary closers 35S formed by sewing or bonding to extend from where the shoulder covering portions 42L and 42R are connected with the back covering portion 41. This allows the back covering portion 41 to be communicated with each of the side back covering portions 41A and 41B via its end portion only.

The boundaries between the front covering portion 43 and the side front covering portion 43A, and between the front covering portion 43 and the side front covering portion 43B are also partly closed by boundary closers 36S formed by sewing or bonding to extend from where the shoulder covering portions 42L and 42R are connected with the front covering portion 43. This allows the front covering portion 43 to communicate with each of the side front covering portions 43A and 43B via its end portion only.

In the configuration of the present embodiment, when the inflator 32 is activated, the pressurized gas released from the inflator 32 flows, as shown by arrows in FIG. 10, from the back covering portion 41 through the shoulder covering portion 42R to the front covering portion 43 while also flowing from the back covering portion 41 to the shoulder covering portion 42L to fill these continuous portions. Thus, the gas can quickly fill these continuously formed portions, i.e. from the back covering portion 41 through to the front covering portion 43.

Furthermore, part of the gas flowing into the back covering portion 41 flows into the side back covering portions 41A and 41B via with the end portion of the back covering portion 41. Similarly, a portion of the gas flowing into the front covering portion 43 flows into the side front covering portions 43A and 43B via with the end portion of the front covering portion 43. Thus, these side back covering portions 41A, 41B and side front covering portions 43A, 43B are also filled with the gas.

Figure 11A:
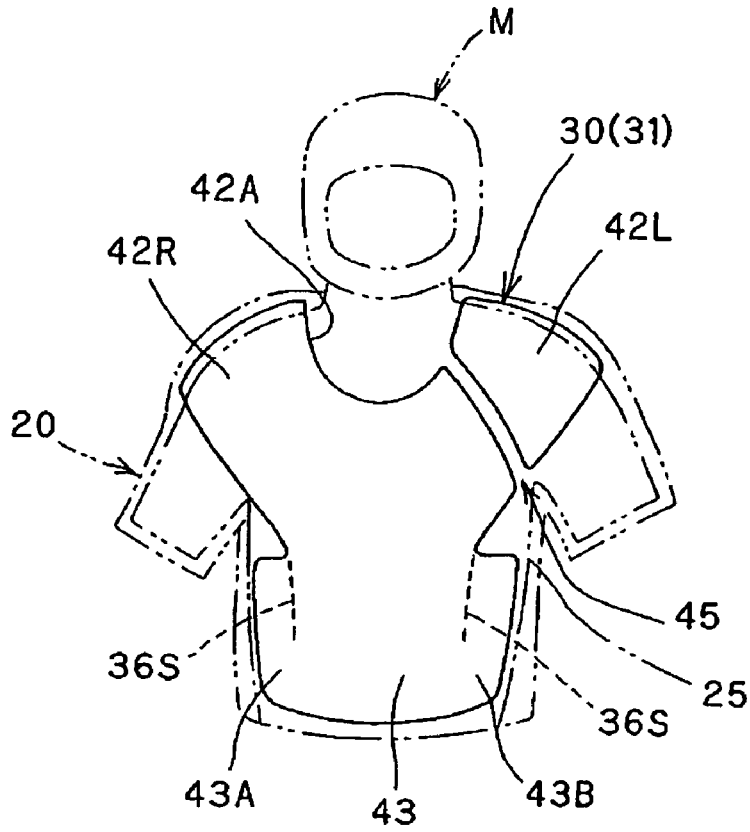
FIG. 11A is a front view of the airbag jacket of FIG. 9 in an inflated state.
Figure 11B:
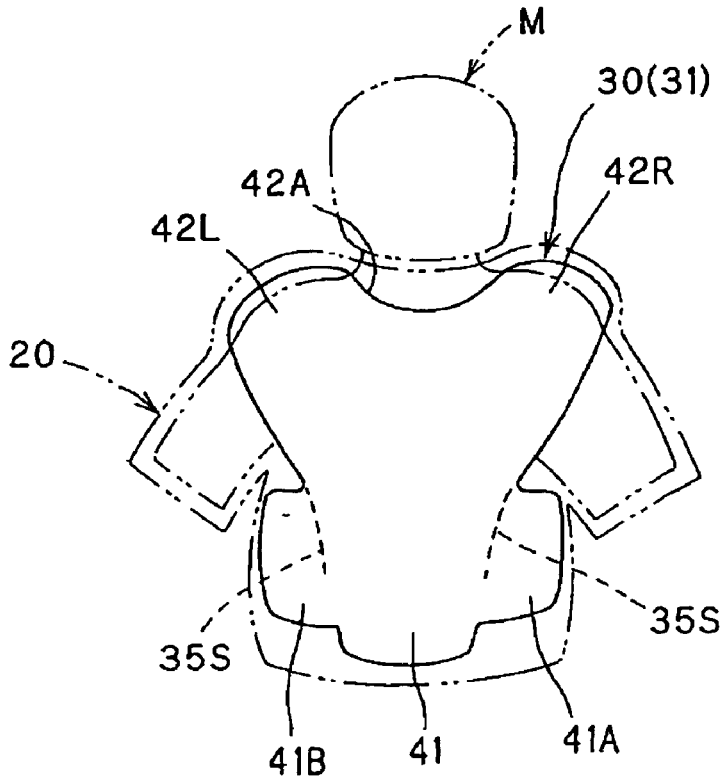
FIG. 11B is a corresponding rear view of the airbag jacket of FIG. 11A.

As shown in FIGS. 11A and 11B, the airbag body 31 having the configuration of the present embodiment, when filled with the gas, covers not only the shoulders and front portions, including left and right abdominal portions of the rider M but also the shoulders and back portion including portions on the left and right sides of the spine of the rider M.

Thus, the airbag body 31 can extensively cover the upper body portion of the rider M compare to that of the airbag body discussed in each of the foregoing embodiments. The airbag body of this embodiment can more securely absorb an impact from the outside on the upper body of the rider M.

The airbag body 31 includes the flat front piece 50 and a flat back piece 52 which are joined together. Therefore, when compared with an airbag body having a complicated three-dimensional shape produced by complicated three-dimensional sewing, the overall shape of the airbag body 31 of the present invention can be simplified, and sewing and/or bonding thereof can easily performed.

The boundary closers 35S, 36S between the back covering portion 41 and the side back covering portions 41A and 41B, and between the front covering portion 43 and the side front covering portions 43A and 43B are formed by sewing or bonding without requiring increased number of components for the airbag body 31. The boundary closers 35S, 36S can be formed in a process in which the airbag body 31 is sewn or bonded.

Fifth Embodiment

Figure 12:
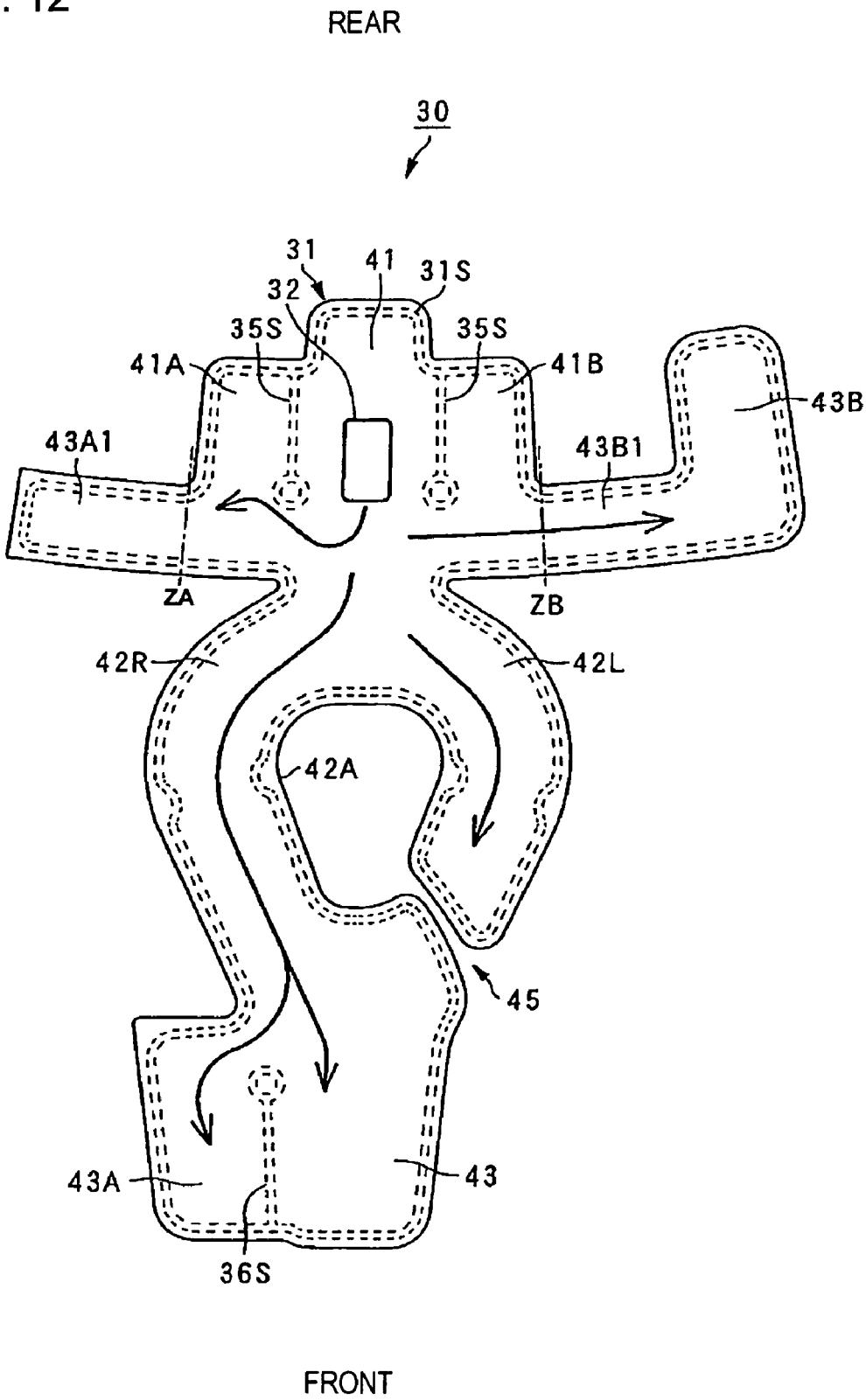
FIG. 12 is a plan view of an airbag jacket in unfolded state according to a fifth embodiment of the present invention.

FIG. 12 shows a fifth embodiment of the present invention. According to the fifth embodiment, the left front flank covering portion 43B is formed continuously with the side back covering portion 41B that is continuous with the back covering portion 41 of the airbag body 31.

In the following description of the present embodiment, the inventive features which are substantially similar to those used in the foregoing embodiments are denoted by the same symbols used in the foregoing embodiments, and their description is omitted. Parts different from those used in the foregoing embodiments are described in detail.

As shown in FIG. 12, the side back covering portion 41B and the left front flank covering portion 43B are connected to each other via a sub-side front covering portion 43B1 having a narrower width than that the side back covering portion 41B and the left front flank covering portion 43B. A sub-side front covering portion 43A1 having a substantially similar width as that of the sub-side front covering portion 43B1 is formed continuously with the side back covering portion 41A opposite to the side back covering portion 41B.

In the configuration of the present embodiment, the left front flank covering portion 43B is formed such that it is continuous with the back covering portion 41. Therefore, of the left and right front covering portions 43A and 43B, only the right front covering portion 43A is required to be continuous with the front covering portion 43. In other words, the front covering portion 43 is not required to be continuous with the left front covering portion 43B.

As shown in FIG. 12, the airbag body 31 is fitted with (in or under) the rider jacket 20 in a state in which is folded at a boundary ZB between the side back covering portion 41B and the sub-side front covering portion 43B1, and also at another boundary ZA between the side back covering portion 41A and the sub-side front covering portion 43A1.

With the airbag body 31 arranged, as described above, when the inflator 32 is activated, the pressurized gas released from the inflator 32 flows, as shown by arrows in FIG. 12, from the back covering portion 41 through the right shoulder covering portion 42R that is continuous with the back covering portion 41 to the front covering portion 43. Simultaneously, the pressurized gas from the inflator flows from the back covering portion 41 to the shoulder covering portion 42L to fill these continuous portions. Thus, the gas can quickly fill the airbag body 31, from the back covering portion 41 through to the front covering portion 43.

Also, simultaneously pressurized gas flowing into the back covering portion 41 flows through the side back covering portion 41B via an end portion of the back covering portion 41 to the sub-side front covering portion 43B1 and the front flank covering portion 43B. At the same time, the gas flows through the side back covering portion 41A to the sub-side front covering portion 43A1 to inflate and deploy these portions. Thus, as in the second embodiment, the airbag body 31 can approximately entirely cover the upper body of the rider M to securely absorb an impact from the outside on the upper body of the rider M.

As described above, in the configuration of the present embodiment, the front flank covering portion 43B is provided continuously with the side back covering portion 41B which is continuous with the back covering portion 41 of the airbag body 31. Therefore, the front covering portion 43 need not be continuous with any side front covering portion to cover the left front flank of the rider M.

This makes it possible that the airbag body 31 entirely covers substantially portions of the upper body of the rider M while reducing the volume of the front covering portion 43 and its vicinity located far apart from the inflator 32. Thus, according to the present embodiment the amount of gas required to inflate the front covering portion 43 side of the airbag body 31 can be reduced compared to that of the third embodiment. Therefore, it is possible to quickly fill the gas in the airbag body 31, from the back covering portion 41 through to the front covering portion 43.

According to the above configuration, the airbag body 31 (airbag jacket 30) is prevented from covering left and right side portions (where pockets are generally provided) of the rider jacket 20. This can prevent the airbag body 31 (airbag jacket 30) from limiting the capacities of pockets of the rider jacket 20.

Even though the present invention has been described based on the illustrative embodiments, it is obvious that the present invention is not limited to these embodiments. For example, although in the above embodiments the airbag body 31 is front-gapped or side-gapped with a front gap or a side gap extending along the fastener line 25 or 26 of the rider jacket 20, the rider jacket 20 to which the present invention is applicable is not limited to such embodiments. Also, as an example, if the rider jacket 20 is configures for side buttoning or front buttoning, the airbag body 31 can be configures so as to allow the rider jacket 20 to be buttoned with ease. Hence, the airbag jacket 30 according to the present invention can easily be fitted in various types of the rider jacket 20, or can be simple worn under a ride's conventional clothing, such as shirt. It is also possible to wear the airbag jacket without fitting it into or under the rider's jacket.

Moreover, in the above embodiments, the present invention is applied to an airbag jacket to be worn by a motorcycle rider, the present invention may be applied to an airbag jacket to be worn by a driver or operator of, for example, a three-wheeled or four-wheeled vehicle classified as an ATV (All Terrain Vehicle) or a small craft.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An airbag jacket for being worn by a vehicle rider, said airbag jacket comprising an airbag body configured to fill with gas and an inflator operatively connected with the airbag body for selectively generating said gas, said airbag body comprising:

a flat front piece; and a flat back piece substantially identical to said flat front piece;

each of the flat front and back pieces having a through hole formed therein for permitting a user of the airbag jacket to pass the vehicle rider's head therethrough;

wherein said flat front piece and said flat back piece are joined together along respective peripheral boundaries thereof, and are also joined together along a peripheral boundary of the through hole, so as to form a plurality of body covering portions comprising at least a back covering portion, a shoulder covering portion and a front covering portion, wherein said body covering portions are integrally connected together to form the airbag body;

wherein the shoulder covering portions are configured and arranged to substantially entirely cover the shoulders of a user;

and wherein the inflator is disposed in the back covering portion; and during activation thereof, gas from the inflator flows from the back covering portion to the front covering portion via the shoulder covering portion so as to fill the plurality of body covering portions.

2. The airbag jacket according to claim 1, wherein the airbag body is substantially laterally symmetrical when worn by the rider, and wherein the maximum width of the airbag body at the shoulder portions is more than twice the width of the front covering portion at an area proximate a lower end thereof.

3. The airbag jacket according to claim 1, wherein said shoulder covering portion has a gap formed in a side portion thereof, such that the airbag body is side-gapped when worn by the rider.

4. The airbag jacket according to claim 1, wherein the front covering portion has a vertical discontinuous portion formed in a front portion thereof such that airbag body is front-gapped when worn by the rider.

5. The airbag jacket according to claim 1, wherein said plurality of body covering portions further comprise at least one side back covering portion formed to be continuous with said back covering portion, and wherein said at least one side back covering portion is filled with gas from the inflator during activation thereof.

6. The airbag jacket according to claim 5, wherein a boundary between the back covering portion and said at least one side back covering portion is partly closed by sewing or bonding.

7. The airbag jacket according to claim 5, wherein said plurality of body covering portions further comprises a front flank covering portion formed to be continuous with said at least one side back covering portion; and wherein said the front flank covering portion is filled with the gas from the inflator during activation thereof.

8. The airbag jacket according to claim 1, wherein said plurality of body covering portions further comprises at least one side front covering portion formed continuously with said front covering portion; wherein said at least one side front covering portion is filled with the gas from the inflator during activation thereof.

9. The airbag jacket according to claim 8, wherein a boundary between the front covering portion and said at least one side front covering portion is partly closed by sewing or bonding.

10. An airbag jacket comprising an airbag body; and an inflator operatively connected with said airbag body;

wherein said airbag body comprises:

a front member;

a rear member substantially identical to the front member;

each of said front and rear members having an opening and a substantially vertical discontinuous portion formed therein; said vertical discontinuous portion extending from the opening to an edge portion of each of said front and rear members;

wherein said front and rear members are joined together along a peripheral boundary thereof, and along a peripheral boundary of the opening and the vertical discontinuous portion so as to form a plurality of body covering portions comprising a back covering portion, a shoulder covering portion, a right front covering portion and a left front covering portion;

wherein the shoulder covering portions are configured and arranged to substantially entirely cover the shoulders of a user;

and wherein the inflator is disposed in the back covering portion; and gas from the inflator during activation thereof flows from the back covering portion to the right and left front covering portions via the shoulder covering portion so as to fill the plurality of body covering portions.

11. The airbag jacket according to claim 10, wherein the airbag body is substantially laterally symmetrical when worn by a user, and wherein the maximum width of the airbag body at the shoulder portions is more than twice the width of the front covering portion at an area proximate a lower end thereof.

12. The airbag jacket according to claim 10, wherein said plurality of body covering portions further comprises at least one side front covering portion formed continuously with one of said left and right front covering portions; wherein said at least one side front covering portion is filled with the gas from the inflator during activation thereof.

13. The airbag jacket according to claim 10, wherein said plurality of body covering portions further comprise at least one side back covering portion formed to be continuous with said back covering portion, and wherein said at least one side back covering portion is filled with gas from the inflator during activation thereof.

14. The airbag jacket according to claim 13, wherein a boundary between the back covering portion and said at least one side back covering portion is partly closed by sewing or bonding.

15. The airbag jacket according to claim 13, wherein said plurality of body covering portions further comprises a front flank covering portion formed to be continuous with said at least one side back covering portion; and wherein said the front flank covering portion is filled with the gas from the inflator during activation thereof.

16. In combination an airbag jacket fitted with a rider jacket, said airbag jacket comprising:

an airbag body; and an inflator operatively connected with said airbag body;

wherein said airbag body comprises:

a front member;

a rear member substantially identical to the front member;

each of said front and rear members having an opening formed therein; said opening being positioned as so be symmetrical with an neck covering portion of the rider jacket;

wherein said front and rear members are joined together along a peripheral boundary thereof, and along a peripheral boundary of the opening so as to form a plurality of body covering portions comprising a back covering portion, a shoulder covering portion, a front covering portion;

wherein the shoulder covering portion is configured and arranged to substantially entirely cover the shoulders of a user;

and wherein the inflator is disposed in the back covering portion; and gas from the inflator during activation thereof flows from the back covering portion to the front covering portion via the shoulder covering portion so as to fill the plurality of body covering portions.

17. The airbag jacket according to claim 16, wherein the airbag body is substantially laterally symmetrical when worn by a user, and wherein the maximum width of the airbag body at the shoulder portions is more than twice the width of the front covering portion at an area proximate a lower end thereof.

18. The airbag jacket according to claim 16, wherein the front covering portion has a vertical discontinuous portion formed therein at a front portion thereof such that airbag body is front-gapped when worn by a user.

19. The airbag jacket according to claim 16, wherein said plurality of body covering portions further comprise at least one side back covering portion formed to be continuous with said back covering portion, and wherein said at least one side back covering portion is filled with gas from the inflator during activation thereof.

20. The airbag jacket according to claim 16, wherein said plurality of body covering portions further comprises at least one side front covering portion formed continuously with said front covering portion; wherein said at least one side front covering portion is filled with the gas from the inflator during activation thereof.

21. A wearable airbag system for providing safety to the rider of a vehicle during a collision or accident, the wearable airbag system comprising:

an inflator for providing pressurized gas for filling an airbag body;

the airbag body comprising a plurality of body covering portions including a flat front piece and a back piece joined into a bag-like shape by sewing or bonding the peripheral edge portion together, the flat back piece comprises a back covering portion centered on the rider spine, left and right shoulder portions and the front piece comprises a front covering portion centered on the riders chest, and a through hole to allow the rider's head therethrough;

the airbag body fitted within a jacket of the rider in a folded state at a boundary between a first side back covering portion and a first sub-side front covering portion and at a boundary between a second side back covering portion and a second sub-side front covering portion;

the first sub-side front covering portion having a substantially similar width as that of the second sub-side front covering portion, the first sub-side covering portion formed continuously with a first side back covering portion, the first side back covering portion opposite a second side back covering portion;

the first front flank covering portion formed continuously with the side back covering portion which is continuous with the back covering portion of the airbag body;

wherein the inflator is disposed in the back covering portion; and during activation thereof, gas from the inflator flows from the back covering portion to the front covering portion via the shoulder covering portion so as to fill the plurality of body covering portions.

* * * * *